US012741795B2

(12) United States Patent
Martin et al.

(10) Patent No.: US 12,741,795 B2
(45) **Date of Patent: *Sep. 22, 2026**

(54) HOME HARDWARE PACKAGE ASSEMBLY

(71) Applicant: LIBERTY HARDWARE MFG. CORP., Winston-Salem, NC (US)

(72) Inventors: Ryan Patrick Martin, Kernersville, NC (US); Yasmeen Gabrielle Coan, Winston-Salem, NC (US); Paul Curtis, Ramsgate (GB); John Robert Aves, Ramsgate (GB)

(73) Assignee: LIBERTY HARDWARE MFG. CORP., Winston-Salem, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/800,729

(22) Filed: Aug. 12, 2024

(65) Prior Publication Data

US 2024/0400281 A1 Dec. 5, 2024

Related U.S. Application Data

(62) Division of application No. 17/374,198, filed on Jul. 13, 2021, now Pat. No. 12,084,245.

(60) Provisional application No. 63/050,879, filed on Jul. 13, 2020.

(51) Int. Cl.
*B65D 73/00* (2006.01)
*B65D 25/22* (2006.01)

(52) U.S. Cl.
CPC ..... *B65D 73/0085* (2013.01); *B65D 25/22* (2013.01)

(58) Field of Classification Search
CPC ..... B65D 73/0078; B65D 73/0085; B65D 25/22; B65D 73/0092; B65D 5/4208; B65D 73/0071; B65D 73/0014; B65D 73/0007
USPC ..... 206/495, 806, 321, 780, 775, 782, 779
See application file for complete search history.

(56) References Cited

U.S. PATENT DOCUMENTS

| | | | | |
|---|---|---|---|---|
| 1,483,195 | A | 2/1924 | Pinkerton | |
| 2,979,192 | A * | 4/1961 | Blonder | B65D 5/4208 206/321 |
| 4,067,169 | A * | 1/1978 | Zampini, Jr. | B65B 15/00 53/397 |
| 4,513,862 | A | 4/1985 | Mallow | |
| 4,549,654 | A * | 10/1985 | Tiesman | B65D 73/0085 248/152 |
| 4,993,845 | A | 2/1991 | Faltynek | |
| 5,392,919 | A * | 2/1995 | Passamoni | B65D 73/0085 206/576 |
| 5,609,248 | A | 3/1997 | Rohrbough et al. | |
| 6,053,322 | A | 4/2000 | Kim et al. | |
| 6,629,609 | B2 | 10/2003 | Cook et al. | |
| 7,070,055 | B2 | 7/2006 | Lechanoine et al. | |
| 7,874,430 | B2 * | 1/2011 | Anderson | B65D 5/4604 229/162.1 |
| 8,006,835 | B2 | 8/2011 | Moore et al. | |
| 9,527,643 | B2 | 12/2016 | Streich et al. | |

(Continued)

OTHER PUBLICATIONS

Canada Office Action for Application No. 3,124,378, dated Apr. 19, 2024, 6 pages.

*Primary Examiner* — Steven A. Reynolds
(74) *Attorney, Agent, or Firm* — Brooks Kushman P.C.

(57) ABSTRACT

A package assembly is provided with a plurality of pivotally connected panels to collectively support a product and define a cavity. A home hardware product is affixed to an exterior side of one of the plurality of panels.

20 Claims, 17 Drawing Sheets

(56) References Cited

U.S. PATENT DOCUMENTS

| | | | | |
|---|---|---|---|---|
| 9,873,556 | B1 | 1/2018 | Dancer et al. | |
| 12,084,245 | B2 * | 9/2024 | Martin | B65D 73/0064 |
| 2005/0016122 | A1 * | 1/2005 | Lai | B65D 5/4229 52/749.1 |
| 2006/0201843 | A1 | 9/2006 | Kellar et al. | |
| 2012/0103982 | A1 * | 5/2012 | McDonald | B65D 5/5035 206/231 |
| 2016/0096658 | A1 * | 4/2016 | Fath | B31B 50/81 493/309 |
| 2016/0207680 | A1 * | 7/2016 | Streich | B65D 77/26 |
| 2016/0236841 | A1 | 8/2016 | Cheng | |

* cited by examiner

HOME HARDWARE PACKAGE ASSEMBLY

CROSS-REFERENCE TO RELATED APPLICATIONS

This application is a division of U.S. application Ser. No. 17/374,198 filed Jul. 13, 2021, now U.S. Pat. No. 12,084,245 B2, which, in turn, claims the benefit of U.S. provisional application Ser. No. 63/050,879 filed Jul. 13, 2020, the disclosures of which are hereby incorporated in their entirety by reference herein.

TECHNICAL FIELD

Various embodiments relate to home hardware package assemblies.

BACKGROUND

Package assemblies have been provided to house, transport, retain and display home hardware for retail.

SUMMARY

According to an embodiment, a package assembly is provided with a plurality of pivotally connected panels to collectively support a product and define a cavity. A home hardware product is affixed to an exterior side of one of the plurality of panels.

According to a further embodiment, the home hardware product is provided with at least one post to mount to an upright support surface. An aperture is formed into one of the plurality of panels sized to receive the post at least partially in the cavity.

According to an even further embodiment, the aperture is formed in a front panel of the plurality of pivotally connected panels. The front panel serves as a backer card.

According to another even further embodiment, at least two of the plurality of pivotally connected panels are pivoted to rollover relative to the front panel to form the cavity.

According to another further embodiment, the cavity extends further than the home hardware product to avoid contact with a sequentially displayed home hardware product.

According to another further embodiment, the plurality of pivotally connected panels is further provided with a back panel and two other panels.

According to another further embodiment, the plurality of pivotally connected panels is further provided with a back panel and at least two of a front panel, a side panel, a top panel, and a bottom panel.

According to an even further embodiment, the bottom panel is sized to support the package assembly upon an underlying support surface.

According to another further embodiment, a fastener connects a pair of the plurality of pivotally connected panels.

According to an even further embodiment, the fastener is further provided as a tab, an adhesive, tape, or a staple.

According to another further embodiment, the home hardware product is not mounted to an insert.

According to another further embodiment, a shrink wrap is not provided over the home hardware product.

According to another further embodiment, a hang tab with a hang tab aperture is formed in one of the plurality of panels.

According to another further embodiment, a wall mount bracket, fasteners, or assembly instructions are housed within the cavity.

According to another further embodiment, the home hardware product is further provided as a towel ring.

According to another further embodiment, the home hardware product is further provided as a toilet paper holder assembly.

According to another further embodiment, the home hardware product is further provided as a hook assembly.

According to another further embodiment, the home hardware product is further provided as a grab bar assembly.

According to another embodiment, a package assembly is provided with a plurality of pivotally connected panels to collectively support a product and define a cavity. A home hardware product is provided with at least one post to mount to an upright support surface. The home hardware product is affixed within the cavity to an interior side of one of the plurality of panels. An aperture is formed into one of the plurality of panels sized to permit at least a portion of the home hardware product to extend out of the cavity.

According to another embodiment, a package assembly is provided with a unitary sheet of material defining a plurality of panels to collectively support a home hardware product and define a cavity.

According to another embodiment, a method of displaying a home hardware product provides a package assembly with a plurality of pivotally connected panels to collectively support and a home hardware product and define a cavity. The home hardware product is installed onto at least one of the plurality of pivotally connected panels of the package assembly at least partially exposed from the cavity for consumer access. A linear array of the packaged hardware products is arranged in a display so that a forward displayed home hardware product is accessible to a consumer and so that the package assembly between sequentially displayed packaged hardware products prevents contact between the sequential home hardware products.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
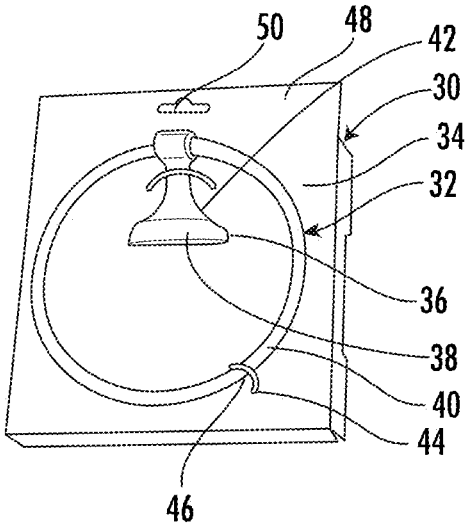
FIG. 1 is a front perspective view of a home hardware package assembly with a towel ring assembly according to an embodiment.
Figure 2:
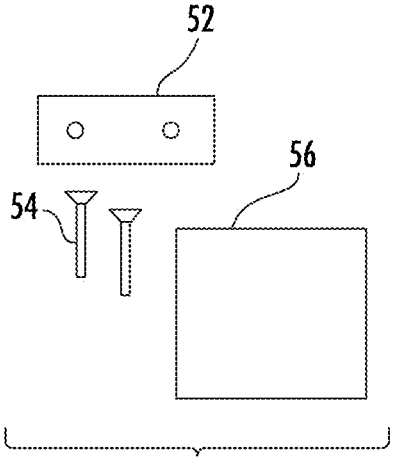
FIG. 2 is front elevation view of a hardware kit of the home hardware package assembly of FIG. 1, according to an embodiment.

FIG. 1 illustrates a home hardware package assembly 30 with a towel ring assembly 32 according to an embodiment. Although the package assembly 30 is illustrated unadorned, the panels of the package assembly 30 may be utilized to apply all printing for the product packaging. The package assembly 30 is provided by a plurality of pivotally connected panels to collectively support the towel ring assembly 32. A front panel 34 serves as a backer card for supporting the towel ring. Other panels of the package assembly 30 collectively combine, also known as rollover, to define a cavity 36 within the package assembly 30, which may be open, or fully enclosed.

The package assembly 30 may be employed with any home hardware product. The depicted home hardware product is the towel ring assembly 32 with a post 38 that is sized to be mounted to an upright support surface, such as a wall. The post 38 has an enlarged terminal end to mount upon, and to conceal, a wall mount bracket. A towel ring 40 is pivotally connected to a distal end of the post 38.

The towel ring assembly 32 is attached to an exterior side of the front panel 34. A cutout aperture 42 is formed into the front panel 34 and sized to match a profile of the post 38 so that a portion of the post 38 extends into the cavity 36 for compactness of the home hardware package assembly 30 with the towel ring assembly 32. A plurality of apertures 44 are formed in the front panel about the post 38 and the towel ring 40. Ties 46 extend through the apertures 44 to attach the post 38 and the towel ring 40 to the front panel 34. The ties 46 may be cable, plastic, elastic, staples, or the like.

The package assembly 30 permits customer access to the entire towel ring assembly 32, with the entire towel ring 40 exposed, and a majority of the post 38 exposed. The towel ring assembly 32 is accessible for a consumer for visual and tactile inspection of the towel ring assembly 32 and the surface finish. The towel ring assembly 32 is unobstructed from a shrink wrap or other material according to an embodiment. Such protective coverings may reflect light that may otherwise interfere with an inspection of the surface finish. The towel ring assembly 32 is also not mounted to an insert within an outer package or tray, which consequently casts shadows and obfuscates the appearance of the packaged product.

The front panel 34 may extend above the rollover panels to provide a hang tab 48 with a hang tab aperture 50. The hang tab 48 permits the packaged towel ring assembly 30, 32 to be hung from a hang rack peg display at a point-of-sale. A linear array of the packaged towel ring assemblies 30, 32 can be retailed at the display such that the package assemblies 30 separate the towel ring assemblies 32 to prevent the sequentially displayed towel ring assemblies 32 from contacting each other to avoid damage to sequential products.

The rollover cavity 36 may be employed to partially receive the post 38, while spacing sequential towel ring assemblies 32. The rollover cavity 36 may also be utilized to house and retain additional hardware and materials, including a wall mount bracket 52, fasteners 54, and assembly directions 56. The fasteners 54 are employed for installing the wall mount bracket 52 to the wall. Then the post 38 is installed upon the wall mount bracket 52.

Figure 3:
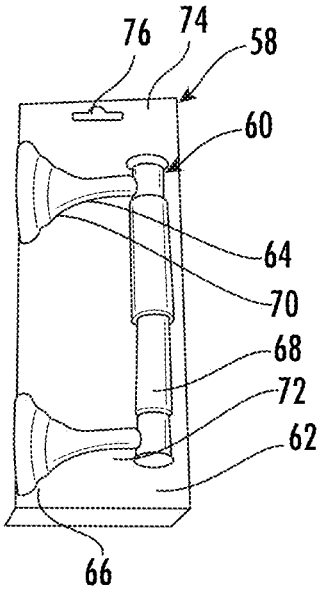
FIG. 3 is a front perspective view of a home hardware package assembly with a toilet paper holder assembly according to another embodiment.

FIG. 3 illustrates a home hardware package assembly 58 for a toilet paper holder assembly 60. Similar to the prior embodiment, the package assembly 58 includes a front panel 62 and a plurality of pivotally connected panels that provide a rear rollover to define a cavity 64. The toilet paper holder assembly 60 includes a pair of posts 66 and a collapsible toilet paper rod 68. A pair of cutout apertures 70 are provided in the front panel 62 to receive the posts 66 into the cavity 64. A plurality of tie apertures 72 are provided to tie the posts 66 and the toilet paper rod 68 to the front panel 62. The front panel 62 provides a hang tab 74 with a hang tab aperture 76 for displaying the toilet paper holder package assembly 58.

Figure 4:
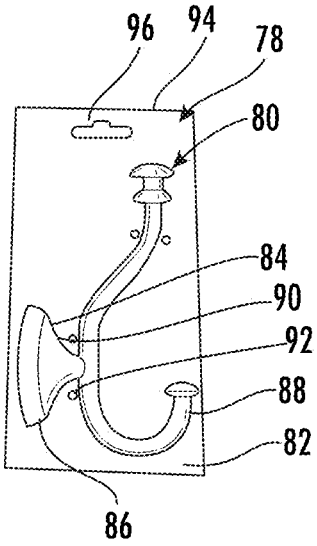
FIG. 4 is a front perspective view of a home hardware package assembly with a hook assembly according to another embodiment.

FIG. 4 illustrates a home hardware package assembly 78 for a hook assembly 80. Similar to the prior embodiments, the package assembly 78 includes a front panel 82 and a plurality of pivotally connected panels that provide a rear rollover to define a cavity 84. The hook assembly 80 includes a post 86 and a hook 88. A cutout aperture 90 is provided in the front panel 82 to receive the post 86 into the cavity 84. A plurality of tie apertures 92 are provided to tie the post 86 and the hook 88 to the front panel 82. The front panel 82 provides a hang tab 94 with a hang tab aperture 96 for displaying the hook assembly 78.

Figure 5:
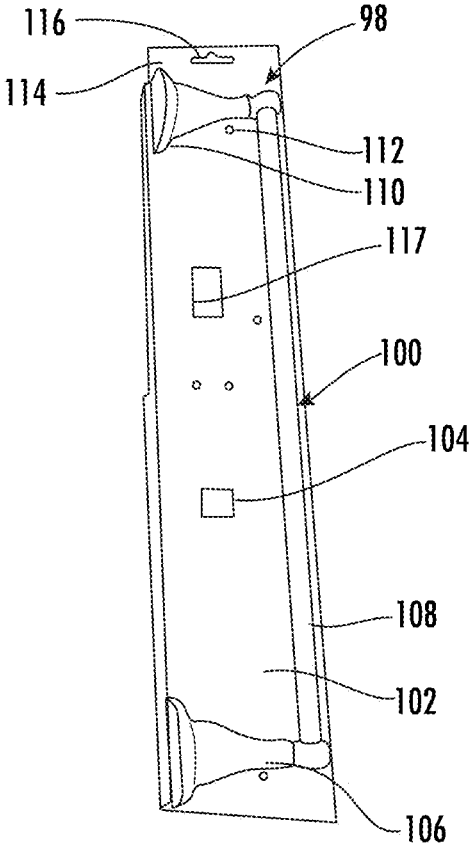
FIG. 5 is a front perspective view of a home hardware package assembly with a towel bar assembly according to another embodiment.

FIG. 5 illustrates a home hardware package assembly 98 for a towel bar assembly 100. Similar to the prior embodiments, the package assembly 98 includes a front panel 102 and a plurality of pivotally connected panels that provide a rear rollover to define a cavity 104. The towel bar assembly 100 includes a pair of posts 106 and a towel bar 108. A pair of cutout apertures 110 are provided in the front panel 102 to receive the posts 106 into the cavity 104. A plurality of tie apertures 112 are provided to tie the posts 106 and the towel bar 108 to the front panel 102. The front panel 102 provides a hang tab 114 with a hang tab aperture 116 for displaying the towel assembly 98. The hardware package assembly 98 is scalable for utilization with towel bar assemblies 100 of various lengths. Additional apertures 117 can be included in the front panel 102 to attach additional assemblies such as retainers for extendable bars or the like. Although a towel bar assembly 100 is described, the home hardware assembly 100 may be a grab bar assembly 100, according to another embodiment to be grasped for assisting and supporting an end user.

Figure 6:
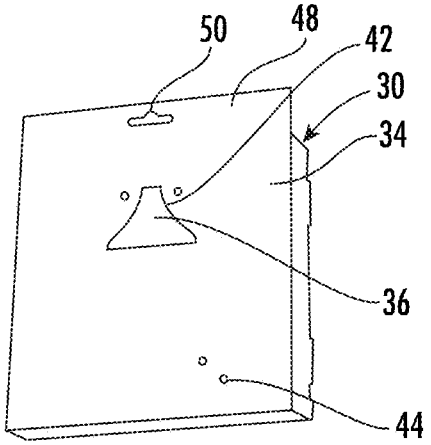
FIG. 6 is a front perspective view of the home hardware package assembly of FIG. 1.
Figure 7:
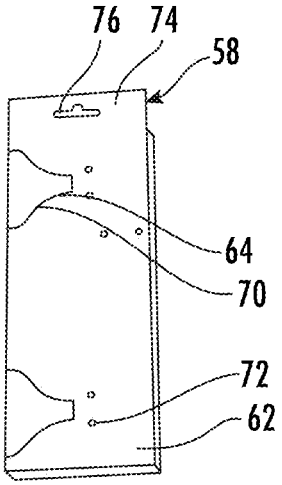
FIG. 7 is a front perspective view of the home hardware package assembly of FIG. 3.
Figure 8:
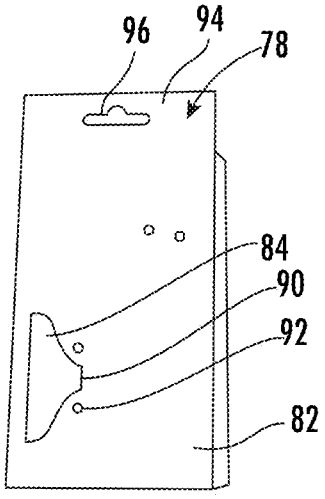
FIG. 8 is a front perspective view of the home hardware package assembly of FIG. 4.
Figure 9:
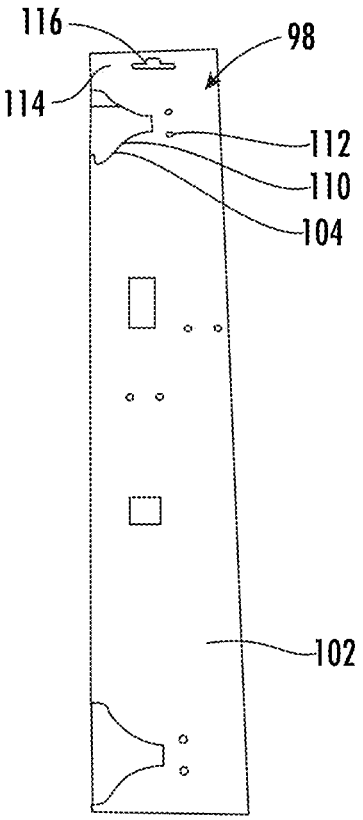
FIG. 9 is a front perspective view of the home hardware package assembly of FIG. 5.

FIG. 6 illustrates the home hardware package assembly 30 without the towel ring assembly 32. FIG. 7 illustrate the home hardware package assembly 58 without the toilet paper holder assembly 60. FIG. 8 illustrates the home hardware package assembly 78 without the hook assembly 80. FIG. 9 illustrates the home hardware package assembly 98 without the towel bar assembly 100.

Figure 10:
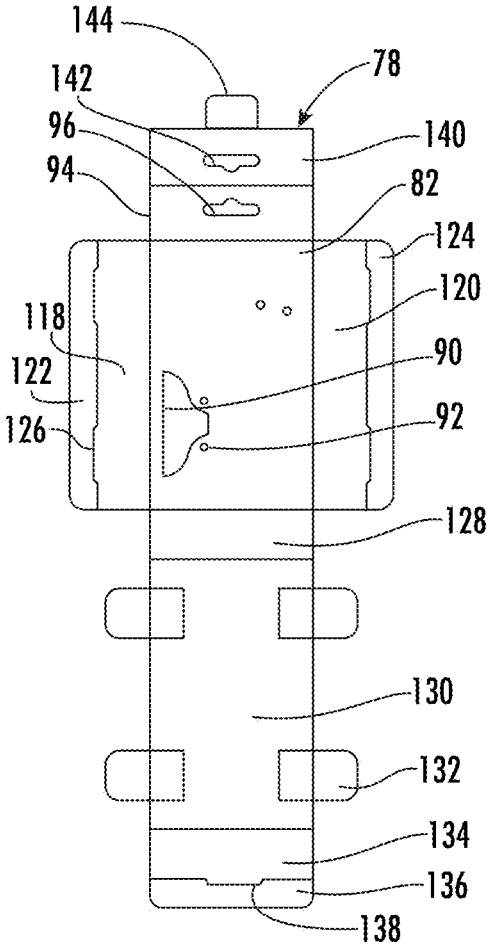
FIG. 10 a top plan view of a blank of the home hardware package assembly of FIG. 4, according to an embodiment.

FIG. 10 illustrates the home hardware packaging assembly 78 as a blank, which is a unitary sheet of material, such as cardboard. A pair of side panels 118, 120 are pivotally connected to lateral sides of the front panel 82. A side flap 122, 124 is pivotally connected to each side panel 118, 120. The intersection of the side flaps 122, 124 with the side panels 118, 120 are slit and folded to provides slots 126. A bottom panel 128 is pivotally connected to a bottom of the front panel 82. A rear panel 130 is pivotally connected to the bottom panel 128.

The side panels 118, 120 and the bottom panel 128 are all pivoted rearward from the front panel 82. The side flaps 122, 124 are folded toward the interior side of the front panel 82. Then, the rear panel 130 is folded upward against the side flaps 122, 124. A plurality of tabs 132 are provided on lateral sides of the rear panel 130 to be inserted into the slots 126 to fasten the rear panel 130 to the side panels 118, 120. A top panel 134 is pivotally connected to a top of the rear panel 130 to fold across the side panels 118, 120 to enclose the cavity 84 within the front panel 82, side panels 118, 120, bottom panel 128, rear panel 130 and top panel 134.

A center flap 136 is provided upon the top panel 134 to be inserted into the cavity 84 along the interior of the front panel 82. The cutting and folding of the center flap 136 along the top panel 134 provides a central slot 138. A rear hang tab 140 is pivotally connected to the front hang tab 94 to fold across the front hang tab 94 to enhance the stability of the front hang tab 94. A rear hang tab aperture 142 is formed through the rear hang tab 140 aligned with the front hang tab aperture 96. A center tab 144 is pivotally connected to the rear hang tab 140 to extend into the slot 138 to fasten the hang tab 94, 140 to the top panel 134. Alternatively, any fastener, such as an adhesive, tape or staples, may be employed instead of tuck tabs 122, 124, 136, and locking tabs 132, 144 in slots 126, 138.

The home product packaging assembly 78 significantly reduces an amount of material in comparison to the prior art that utilizes an insert within an outer housing or tray with a window. The reduction in material saves material costs and shipping costs. For example, the towel ring product packaging assembly 30 reduces the packaging material by forty-four percent. The solid rear panel 130 of the product packaging assembly 78 is rolled over to cover and protect a back side of the hook assembly 80 from a rearward sequential arranged hook assembly 80 in a sequential product packaging assembly 78.

Figure 11:
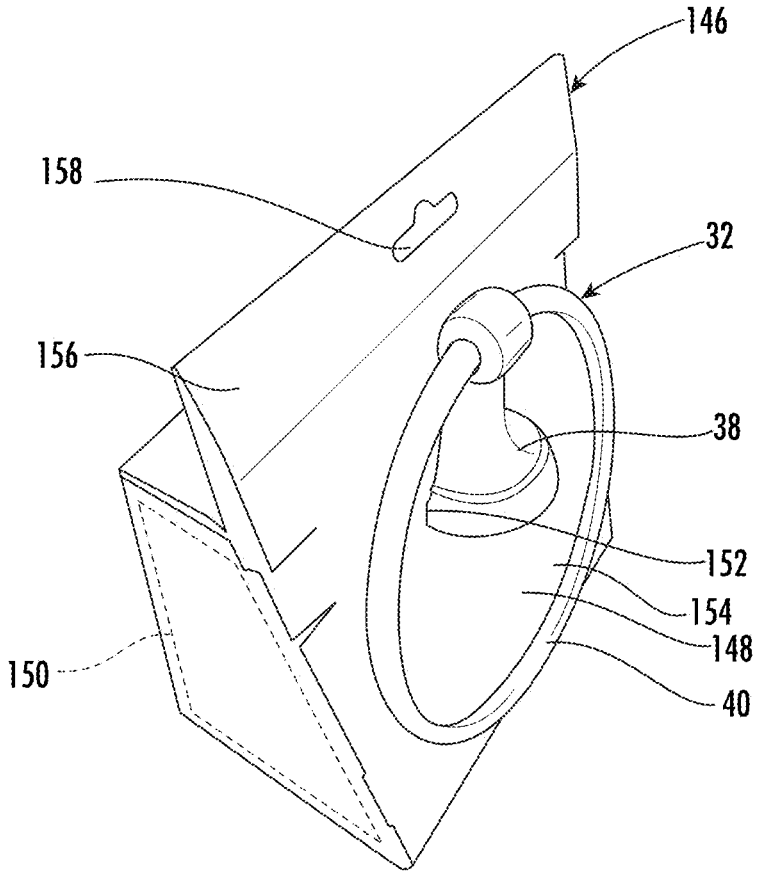
FIG. 11 is a perspective view of a home hardware package assembly with a towel ring according to another embodiment.
Figure 12:
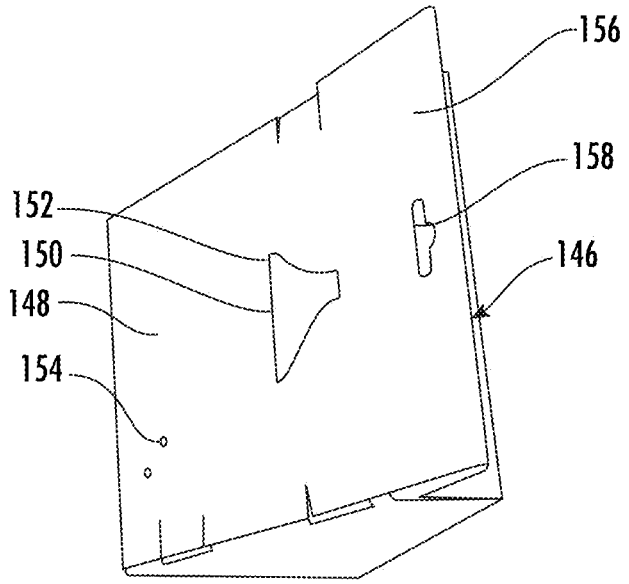
FIG. 12 is a perspective view of the home hardware package assembly of FIG. 11.

FIG. 11 illustrates another home hardware package assembly 146 for the towel ring assembly 32. A front panel 148 is angled such that a cavity 150 is narrower at the top than the bottom. A post aperture 152 is formed into the front panel 148 to receive a portion of the post 38. A plurality of tie apertures 154 are provided to receive ties to attach the post 38 and the towel ring 40 to the front panel 148. According to an embodiment, an optional forward hang tab 156 extends above the front panel 148 with a hang tab aperture 158 formed therethrough. FIG. 12 illustrates the home hardware package assembly 146 without the towel ring assembly 32.

Figure 13:
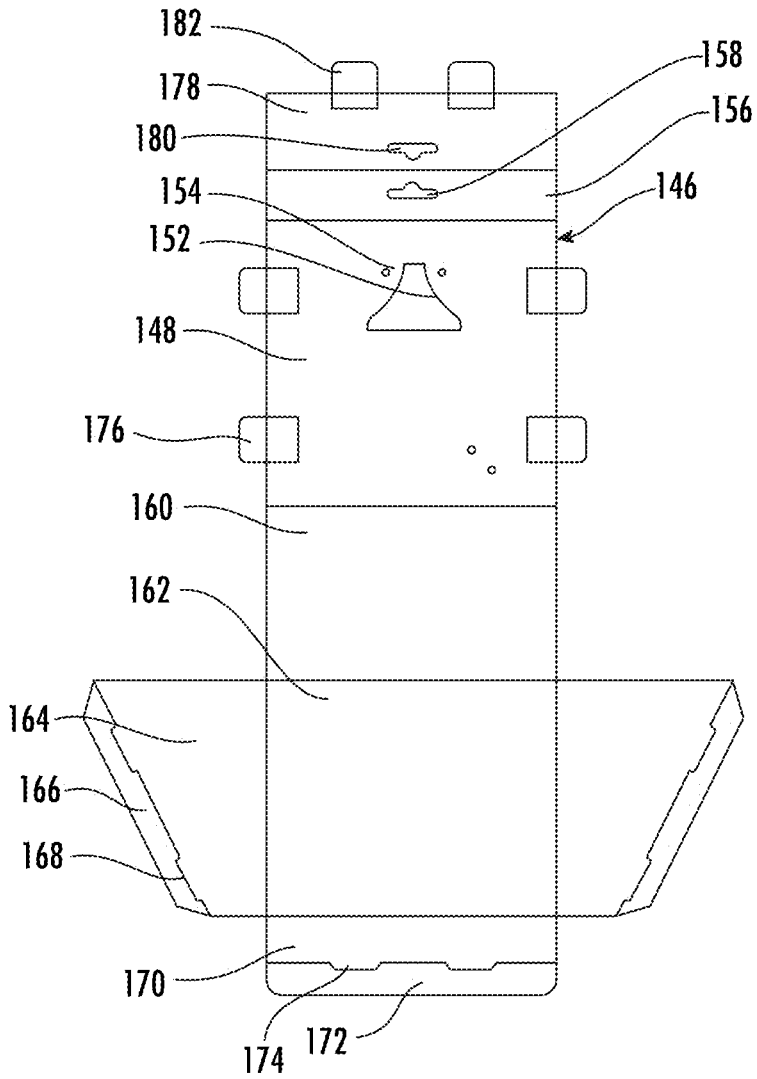
FIG. 13 is a top plan view of a blank of the home hardware package assembly of FIG. 11.

FIG. 13 illustrates the home hardware packaging assembly 146 as a blank. A bottom panel 160 is pivotally connected to a lower end of the front panel 148. A rear panel 162 is pivotally connected to a rear end of the bottom panel 160. A pair of trapezoidal side panels 164 are each pivotally connected to a lateral side of the rear panel 162 and angled to decrease the cavity from the bottom panel 160 along the angled front panel 148. A side flap 166 is pivotally connected to each side panel 164. The intersection of the side flaps 166 with the side panels 164 are slit and folded to provides slots 168.

The bottom panel 160 is pivoted rearward, the back panel 162 is pivoted upward, and the side panels 164 are pivoted forward toward the front panel 148. Alternatively, the side panels 164 could be pivotally connected to the front panel 148 to pivot rearwards. The side flaps 166 are folded toward the interior side of the front panel 148. A plurality of tabs 176 are provided on lateral sides of the front panel 148 to be inserted into the slots 168 to fasten the front panel 148 to the side panels 164. A top panel 170 is pivotally connected to a top of the rear panel 162 to fold across the side panels 164 to enclose the cavity 84 within the front panel 148, side panels 164, bottom panel 160, rear panel 162 and top panel 170.

A center flap 172 is provided upon the top panel 170 to be inserted into the cavity 150 along the interior of the front panel 148. The cutting and folding of the center flap 172 along the top panel 170 provides slots 174. A rear hang tab 178 is pivotally connected to the front hang tab 156 to fold across the front hang tab 156 to enhance the stability of the front hang tab 156. A rear hang tab aperture 180 is formed through the rear hang tab 178 aligned with the front hang tab aperture 158. Locking tabs 182 are pivotally connected to the rear hang tab 178 to extend into the slots 174 to fasten the hang tab 156, 178 to the top panel 170.

The home hardware packaging assembly 146 of FIGS. 11-13 is sized to be displayed by standing directly upon a shelf or to hang upon a peg with the hanging tabs 156, 178. The enlarged bottom panel 160 and the angled front panel 148 position a center of gravity of the packaging assembly 146 and the towel ring assembly 32 over the bottom panel to stand upon the shelf, while presenting the towel ring assembly 32 upright for customer viewing. The home hardware packaging assembly 146 with the enlarged base can be scaled for various home hardware products, such as towel bar assemblies, toilet paper holder assemblies, hook assemblies, grab bar assemblies, and the like.

Figure 14:
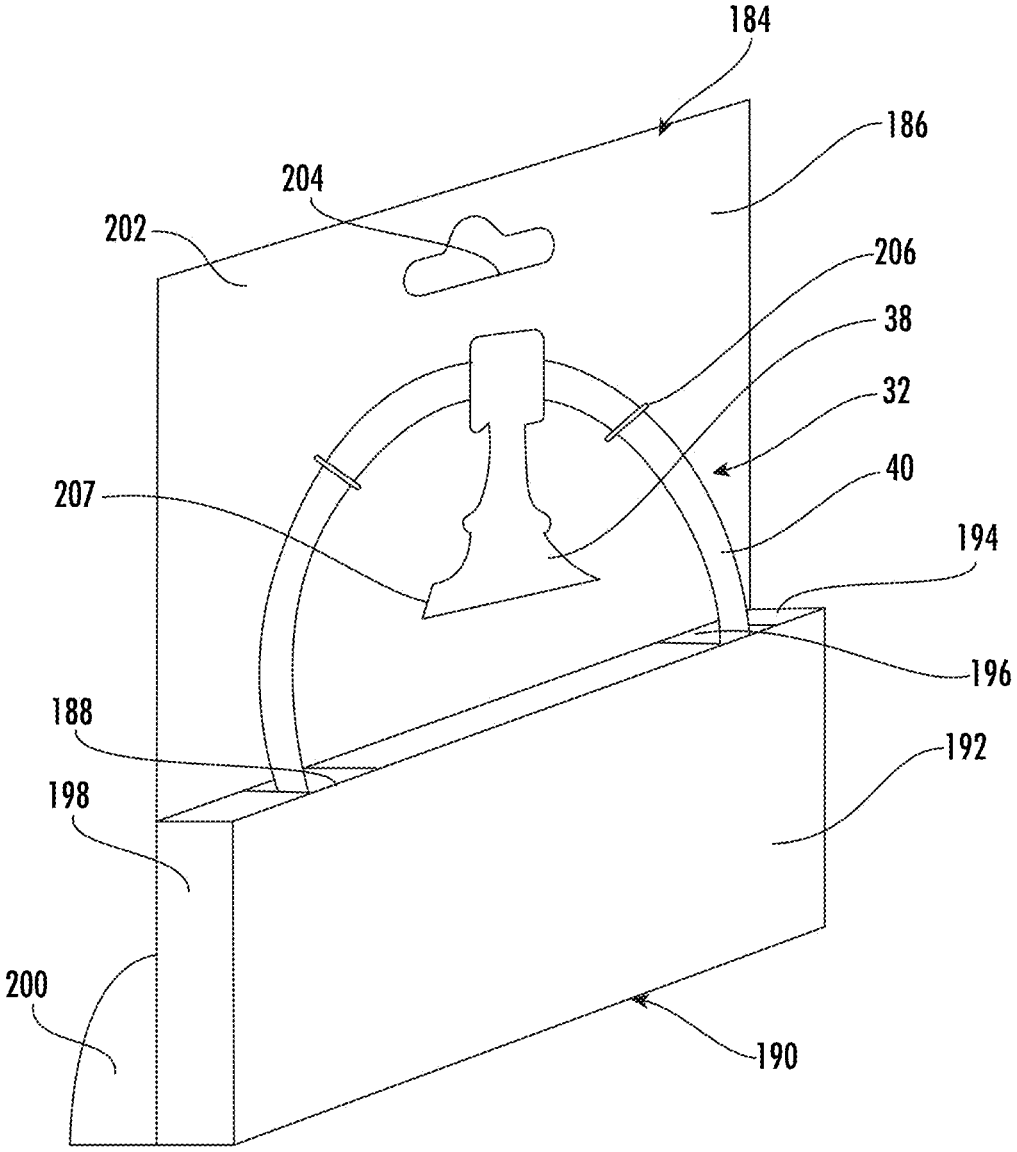
FIG. 14 is a front perspective view of a home hardware package assembly with a towel ring according to another embodiment.

FIG. 14 illustrates a home hardware package assembly 184 for the towel ring assembly 32 according to another embodiment. A rear panel 186 is provided with a rollover in the front of the package assembly 184 so that a cavity 188 is provided on a front side of the package assembly 184. A bottom panel 190 extends forward from the rear panel 186, with a front panel 192 extending upward from the bottom panel 190. A top panel 194 extends rearward from the front panel 192 with slots 196 for clearance of the towel ring 40. Side panels 198 conceal lateral sides of the cavity 188. Side flaps 200 may be provided to assist in standing the package assembly upright on a shelf. Otherwise, a hang tab 202 extends from the rear panel 186 with a hang tab aperture 204 for support and display of the package assembly 184 on a peg. The hang tab panel 202 may be one layer of support, or may be rolled over for two layers of support. Ties 206 may be provided to attach the post 38 and the towel ring 40 to the rear panel 186.

The rear panel 186 includes an aperture 207 formed therethrough to receive the post 38 therein. The cavity 188 sticks out further than the post 38 to avoid contact of sequential posts 38. The towel ring 40 is partially enclosed within the cavity 188, but also partially exposed for consumer access.

Figure 15:
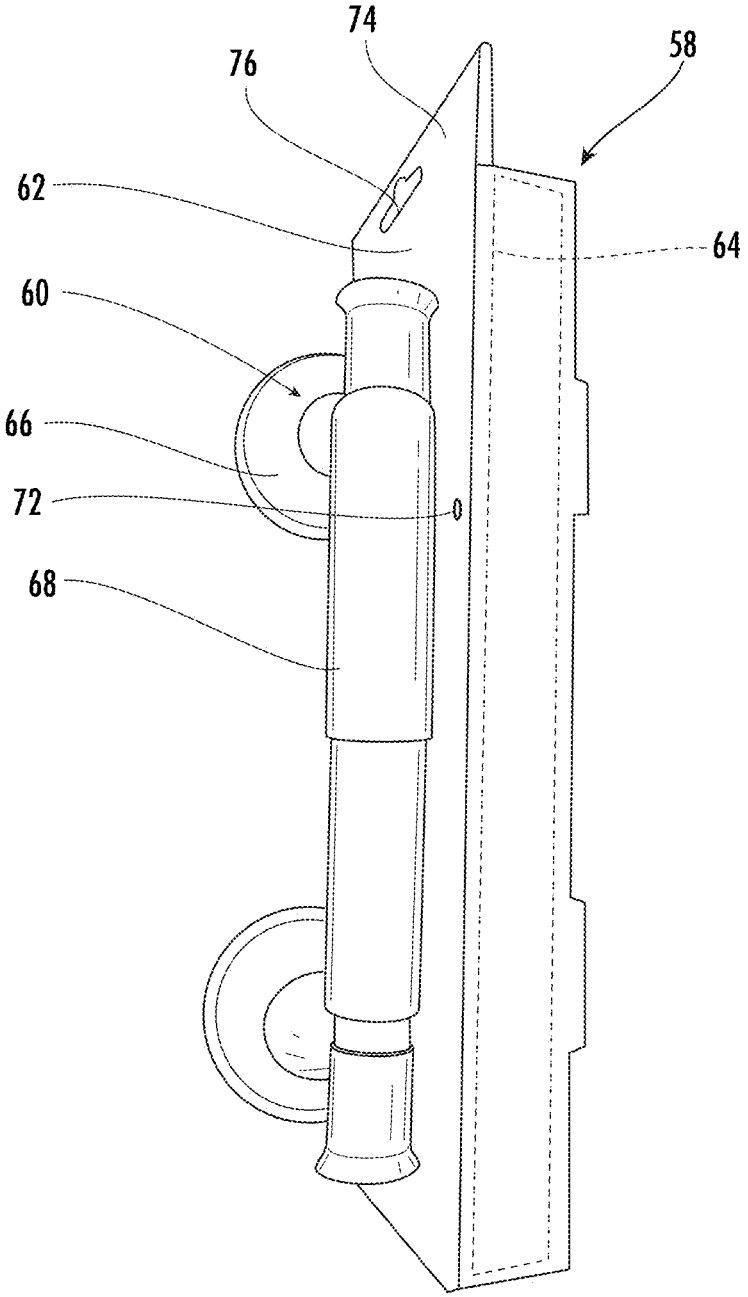
FIG. 15 is a right side perspective view of the home hardware package assembly with the toilet paper holder assembly of FIG. 3.

FIG. 15 illustrates a side perspective view of the home hardware package assembly 58 for the toilet paper holder assembly 60. The cavity 64 is provided rearward of the front panel 62 opposed to the mounting surface of the toilet paper holder assembly 60.

Figure 16:
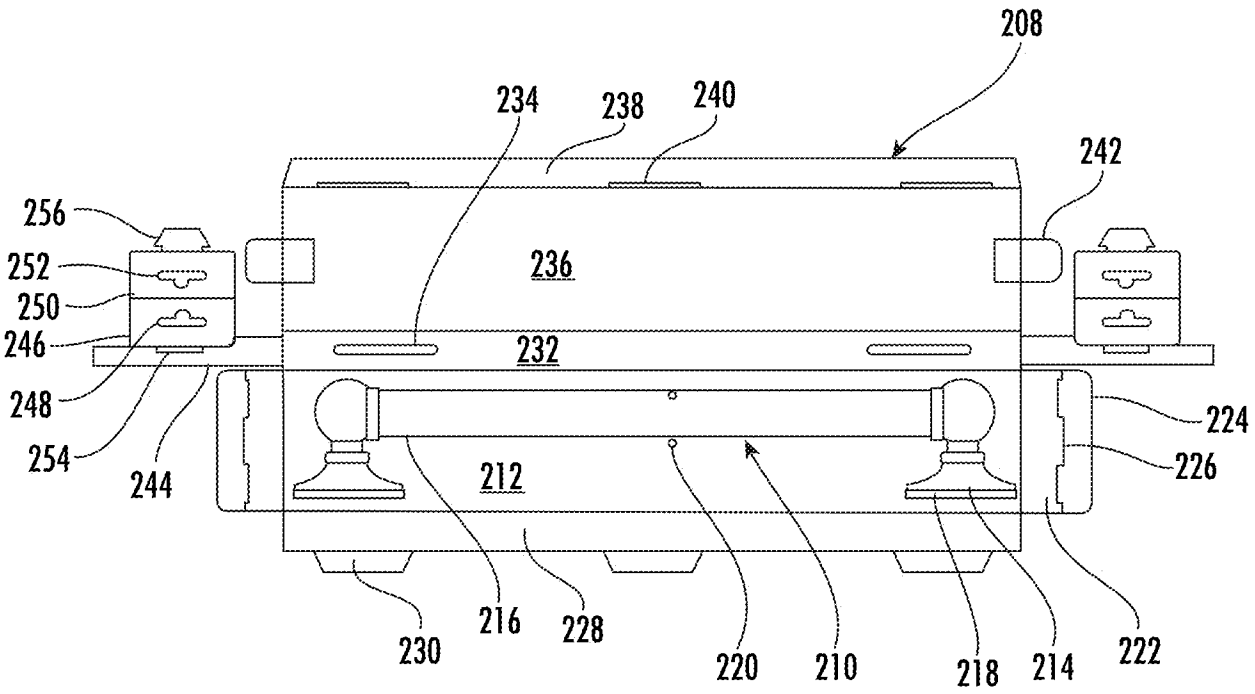
FIG. 16 is a top plan view of a blank of a home hardware package assembly with a grab bar according to another embodiment.

FIG. 16 illustrates a home hardware package assembly 208 for a grab bar assembly 210 according to another embodiment for displaying the grab bar assembly 210 in a horizontal orientation. The home hardware package assembly 208 is illustrated as a blank, which reduces the overall area of cardboard by sixty percent in comparison to the prior art packaging with an insert within an open tray. The package assembly 208 includes a front panel 212 for attachment of a post 214 and a towel bar 216 of the grab bar assembly 210. Post apertures 218 are formed in the front panel 212 to receive a portion of the posts 214. Tie apertures 220 are provided to tie the posts 214 and the towel bar 216 to the front panel 212.

Side panels 222 are pivotally connected to lateral sides of the front panel 212. A side flap 224 is pivotally connected to each side panel 222. A slot 226 is formed in each fold of the side flap 224 relative to the side panel 222. A bottom panel 228 is pivotally connected to a lower edge of the front panel 212. Tabs 230 are provided on the bottom panel 228. A top panel 232 is pivotally connected to a top edge of the front panel 212. A pair of slots 234 are formed through the top panel 232. A rear panel 236 is pivotally connected to a rear edge of the top panel 232. A bottom flap 238 is pivotally connected to a bottom edge of the rear panel 236 with slots 240 at the intersection to receive the tabs 230 of the bottom panel 228. Tabs 242 extend from lateral ends of the rear panel 236 to extend into the slots 226 to attach to the side panels 222.

A pair of minor flaps 244 are provided pivotally connected to lateral ends of the top panel 232. Each minor flap 244 includes a first hang tab 246 pivotally connected to the minor flap 244. A hang tab aperture 248 is formed through the first hang tab 246. A second hang tab 250 is pivotally connected to the first hang tab 246 with a hang tab aperture 252 aligned with the first hang tab aperture 248. A slot 254 is formed at the intersection of the first lock tab 246 and the minor flap 244. A locking tab 256 extends from the second hang tab 250. The second hang tab 250 is folded over the first hang tab 246 and the locking tab 256 is inserted into the slot 254. Then the minor flap 244 is folded into the cavity beneath the top panel 232, and the hang tabs 246, 250 are inserted through the slots 234. The hang tabs 246, 250 are assembled prior to the enclosing of the side panels 222. The home product packaging 208 is scalable and may be utilized with the towel bar assembly 100 with a packaging material reduction of fifty percent. The home product packaging assembly 208 may also be utilized with a variety of other home products, such as a grab bar assembly, a towel bar assembly, a toilet paper holder assembly, or the like.

Figure 17:
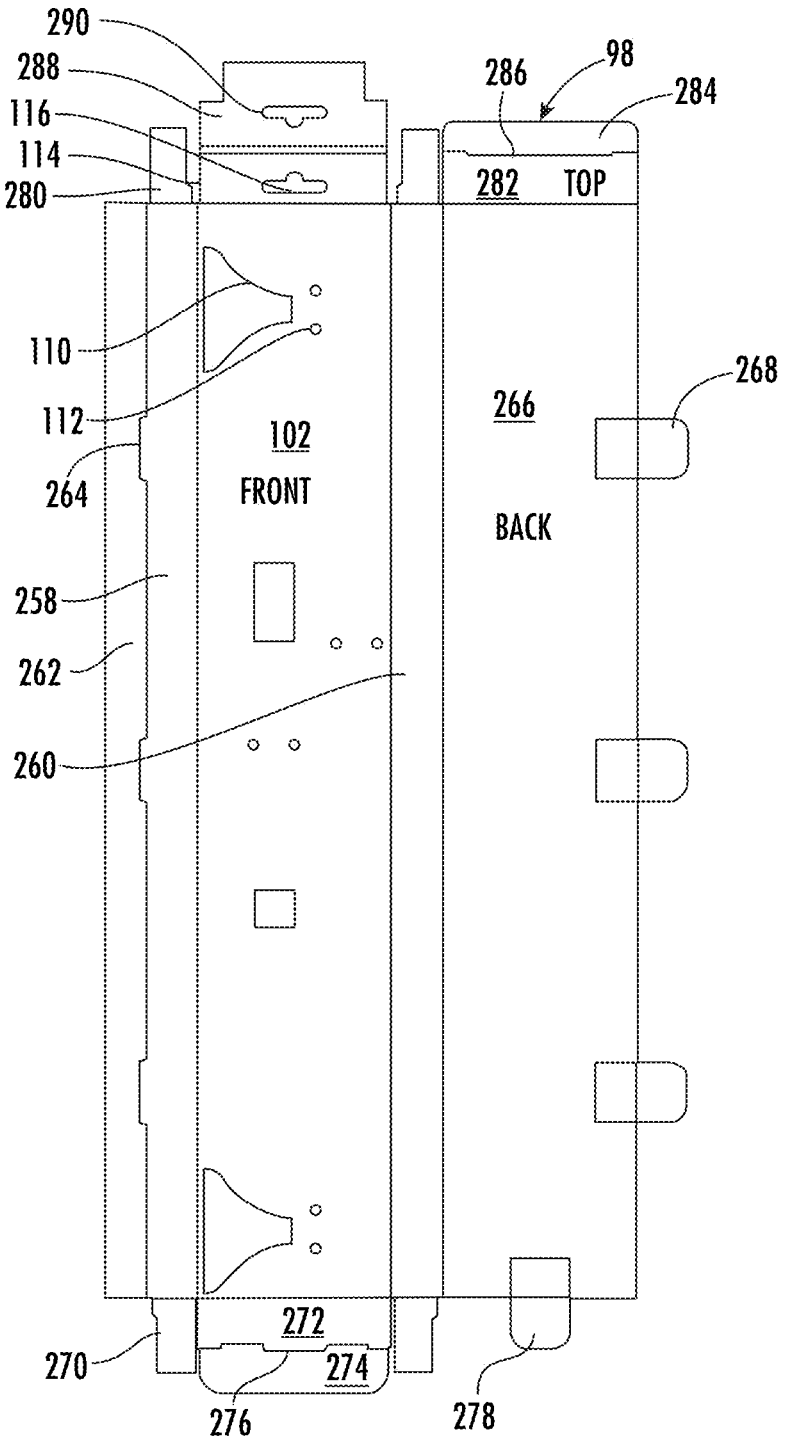
FIG. 17 is a top plan view of a blank of the home hardware package assembly of FIG. 5, according to an embodiment.

FIG. 17 illustrates the home hardware packaging assembly 98 as a blank. A pair of side panels 258, 260 are pivotally connected to lateral sides of the front panel 102. A side flap 262 is pivotally connected to one of the side panels 258. The intersection of the side flap 262 with the side panel 258 is slit and folded to provide slots 264. A rear panel 266 is pivotally connected to the other side panel 260 to engage the side panel 258 with the side flap 262 within the cavity 104. A plurality of tabs 268 are provided on the back panel 266 to lock within the slots 264.

Bottom tabs 270 extend from the side panels 258, 260 to be received within the cavity 104. A bottom panel 272 is pivotally connected to a bottom of the front panel 102. A central flap 274 is pivotally connected to the bottom panel 272 with a slot 276 at the fold. A tab 278 is provided at a bottom of the back panel 266 to lock in the slot 276.

Top tabs 280 extend from the top edges of the side panels 258, 260. A top panel 282 is pivotally connected to a top edge of the back panel 266. A top flap 284 is pivotally connected to the top panel 282 with a slot 286 on the fold. A rear hang tab 288 is pivotally connected to the front hang tab 114 to extend into the slot 286 and to lock the hang tabs 114, 288 to the top panel 282. A hang tab aperture 290 is provided in the rear hang tab 288 aligned with the front hang tab aperture 116.

The home product packaging 98 significantly reduces an amount of material in comparison to the prior art that utilizes an insert within an outer housing or tray with a window. For example, the towel bar product packaging assembly 98 reduces the packaging material by fifty-four percent.

Figure 18:
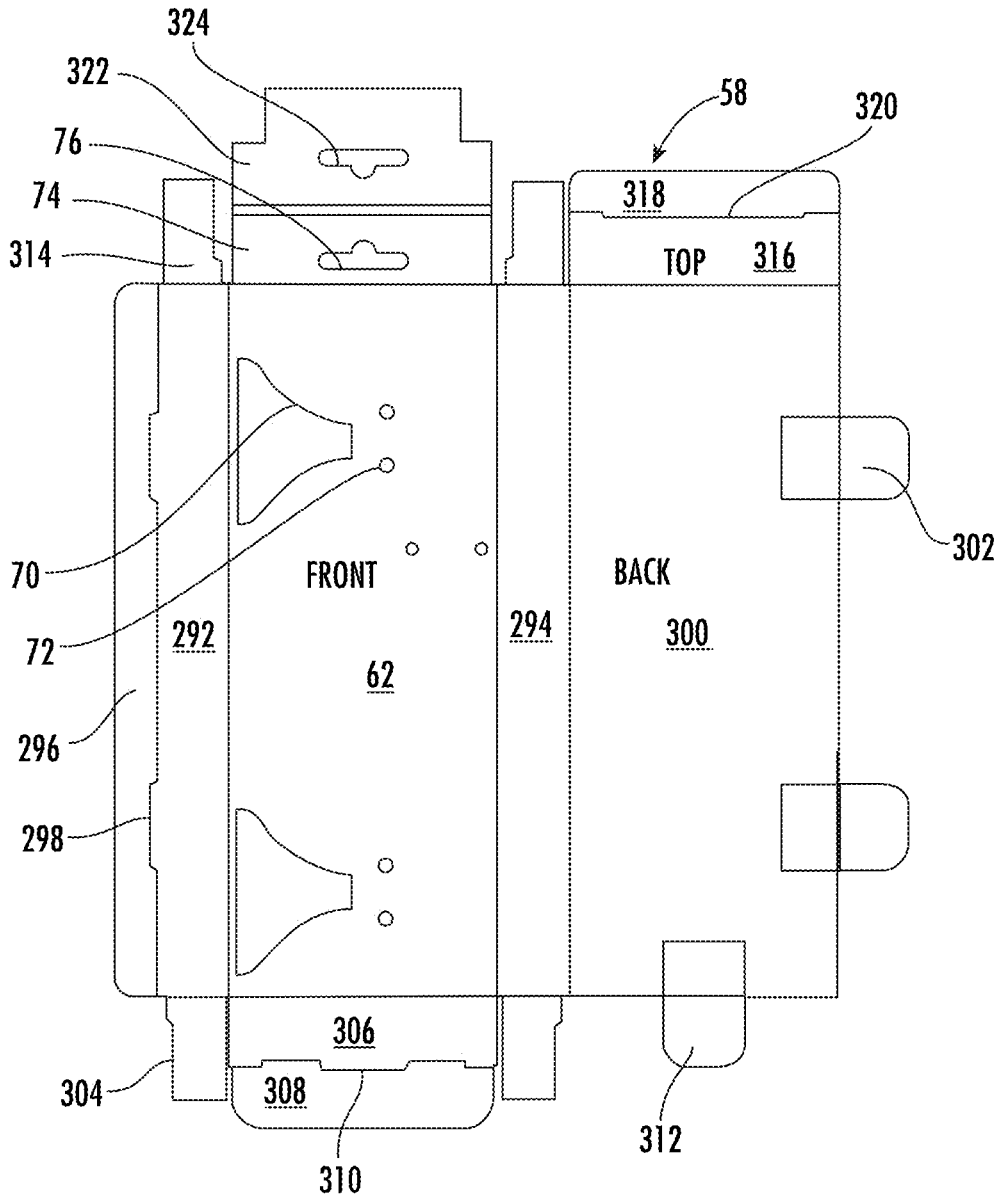
FIG. 18 is a top plan view of a blank of the home hardware package assembly of FIG. 3, according to an embodiment.

FIG. 18 illustrates the home hardware packaging assembly 58 as a blank. A pair of side panels 292, 294 are pivotally connected to lateral sides of the front panel 62. A side flap 296 is pivotally connected to one of the side panels 292. The intersection of the side flap 296 with the side panel 292 is slit and folded to provide slots 298. A rear panel 300 is pivotally connected to the other side panel 294 to engage the side panel 292 with the side flap 296 within the cavity 64. A plurality of tabs 302 are provided on the back panel 300 to lock within the slots 298.

Bottom tabs 304 extend from the side panels 292, 294 to be received within the cavity 64. A bottom panel 306 is pivotally connected to a bottom of the front panel 62. A central flap 308 is pivotally connected to the bottom panel 306 with a slot 310 at the fold. A tab 312 is provided at a bottom of the back panel 300 to lock in the slot 310.

Top tabs 314 extend from the top edges of the side panels 292, 294. A top panel 316 is pivotally connected to a top edge of the back panel 300. A top flap 318 is pivotally connected to the top panel 316 with a slot 320 on the fold. A rear hang tab 322 is pivotally connected to the front hang tab 74 to extend into the slot 320 and to lock the hang tabs 74, 322 to the top panel 316. A hang tab aperture 324 is provided in the rear hang tab 322 aligned with the front hang tab aperture 76.

The home product packaging 58 significantly reduces an amount of material in comparison to the prior art that utilizes an insert within an outer housing or tray with a window. For example, the toilet paper holder product packaging assembly 58 reduces the packaging material by fifty-nine percent.

Figure 19:
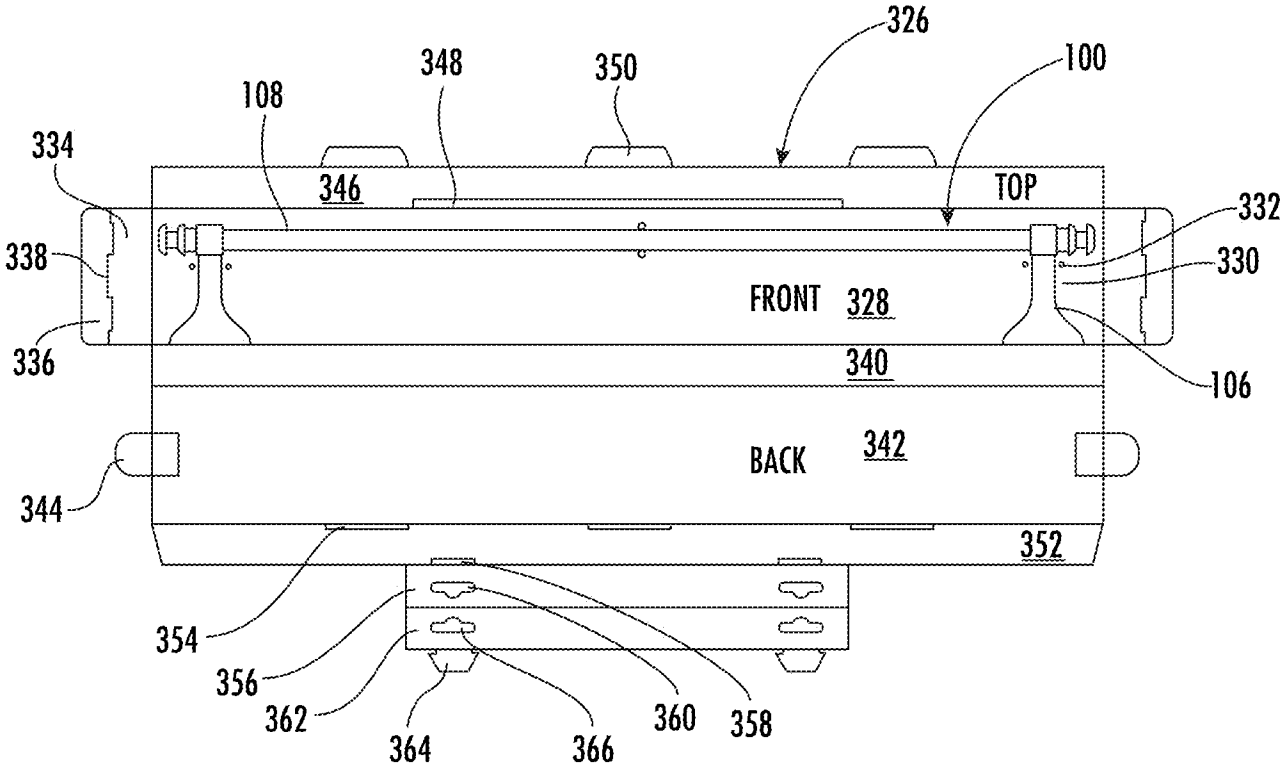
FIG. 19 is a top plan view of a blank of a home hardware package assembly with a towel bar assembly according to another embodiment.

FIG. 19 illustrates a home hardware package assembly 326 for the towel bar assembly 100 according to another embodiment for displaying the towel bar assembly 100 in a horizontal orientation. The home hardware package assembly 326 is illustrated as a blank, which reduces the overall area of the packaging material. The package assembly 326 includes a front panel 328 for attachment of the post 106 and the towel bar 108 of the towel bar assembly 100. Post apertures 330 are formed in the front panel 328 to receive a portion of the posts 106. Tie apertures 332 are provided to tie the posts 106 and the towel bar 108 to the front panel 328.

Side panels 334 are pivotally connected to lateral sides of the front panel 328. A side flap 336 is pivotally connected to each side panel 334. A slot 338 is formed in each fold of the side flap 336 relative to the side panel 334. A bottom panel 340 is pivotally connected to a lower edge of the front panel 328. A rear panel 342 is pivotally connected to the bottom panel 340. Tabs 344 are provided on the rear panel 342 to be received in the slots 338.

A top panel 346 is pivotally connected to a top edge of the front panel 328. A slot 348 is formed at the fold of the top panel 346 and the front panel 328. Locking tabs 350 extend from the top panel 346. A top flap 352 is pivotally connected to a top edge of the rear panel 342 with slots 354 at the intersection to receive the tabs 350.

A first hang tab 356 is pivotally connected to the top flap 352 with slots 358 at the fold. A hang tab aperture 360 is formed through the first hang tab 356. A second hang tab 362 is pivotally connected to the first hang tab 356 with a pair of locking tabs 364 and a hang tab aperture 366 that is aligned with the first hang tab aperture 360. The second hang tab 362 is folded over the first hang tab 356 and the locking tabs 364 are inserted into the slots 358. Then the hang tabs 356, 362 are inserted through the slots 348. The hang tabs 356, 362 are assembled prior to the enclosing of the top panel 346.

Figure 20:
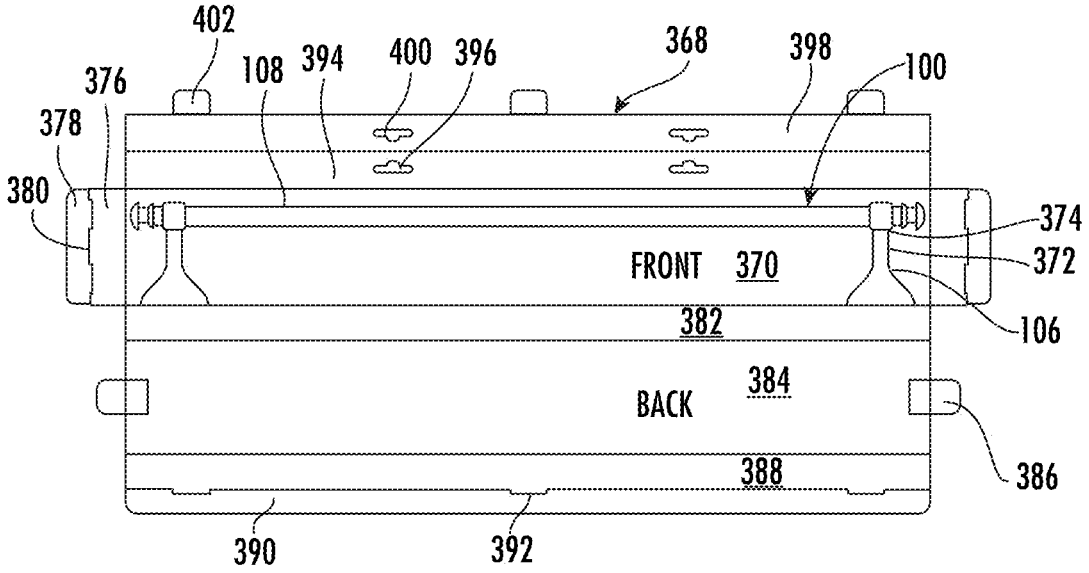
FIG. 20 is a top plan view of a blank of a home hardware package assembly with a towel bar assembly according to another embodiment.

FIG. 20 illustrates a home hardware package assembly 368 for the towel bar assembly 100 according to another embodiment for displaying the towel bar assembly 100 in a horizontal orientation. The home hardware package assembly 368 is illustrated as a blank, which reduces the overall area of the packaging material. The package assembly 368 includes a front panel 370 for attachment of the post 106 and the towel bar 108 of the towel bar assembly 100. Post apertures 372 are formed in the front panel 370 to receive a portion of the posts 106. Tie apertures 374 are provided to tie the posts 106 and the towel bar 108 to the front panel 370.

Side panels 376 are pivotally connected to lateral sides of the front panel 370. A side flap 378 is pivotally connected to each side panel 376. A slot 380 is formed in each fold of the side flap 378 relative to the side panel 376. A bottom panel 382 is pivotally connected to a lower edge of the front panel 370. A rear panel 384 is pivotally connected to the bottom panel 382. Tabs 386 are provided on the rear panel 384 to be received in the slots 380.

A top panel 388 is pivotally connected to a top edge of the rear panel 384. Slots 392 are formed at the fold of the top panel 388 and the rear panel 384. A top flap 390 is pivotally connected to a top edge of the top panel 388 with slots 392 at the intersection.

A first hang tab 394 is pivotally connected to the front panel 370. A hang tab aperture 396 is formed through the first hang tab 394. A second hang tab 398 is pivotally connected to the first hang tab 394 with a hang tab aperture 400 that is aligned with the first hang tab aperture 396. The second hang tab 398 is folded over the first hang tab 394. Locking tabs 402 are inserted into the slots 392.

Figure 21:
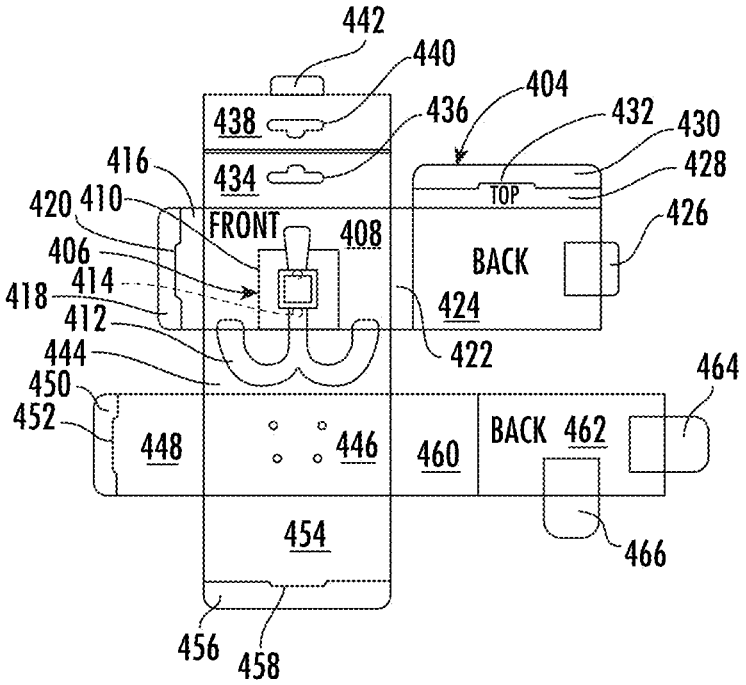
FIG. 21 is a top plan view of a blank of a home hardware package assembly with a hook assembly according to an embodiment.
Figure 22:
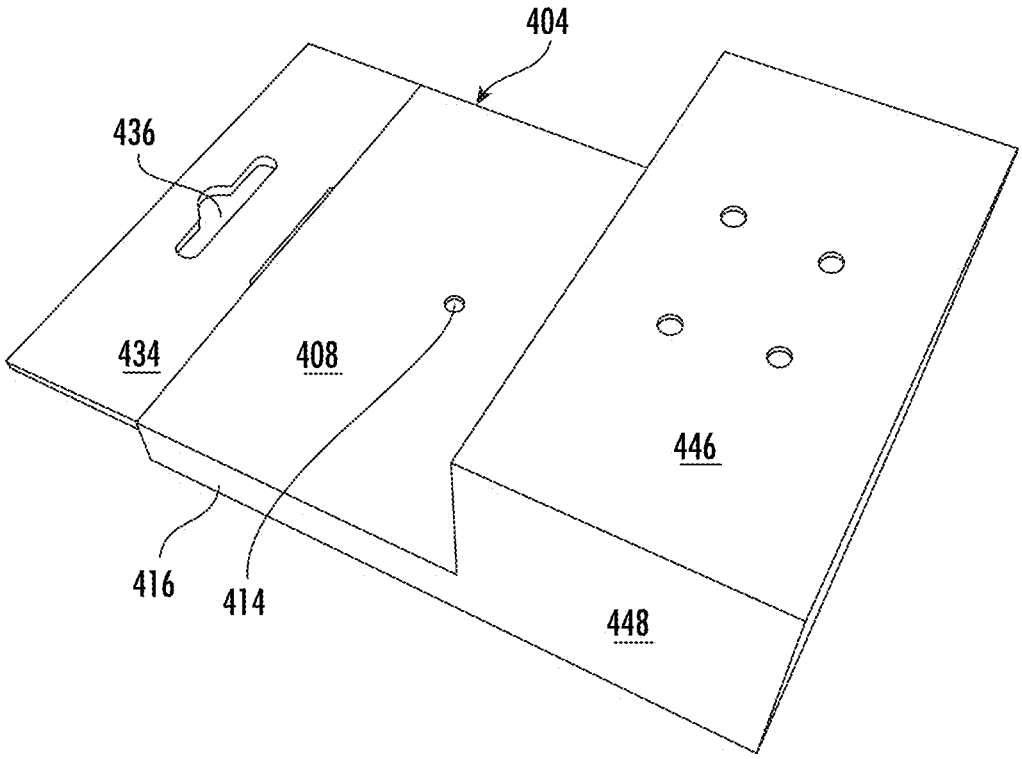
FIG. 22 is a front perspective view of the home hardware package assembly of FIG. 21.

FIG. 21 illustrates a home hardware package assembly 404 for a hook assembly 406. FIG. 22 illustrates the home hardware package assembly 404 without the hook assembly 406. The package assembly 404 includes a first front panel 408. The hook assembly 406 includes a post 410 mounted to the first front panel 408 and a double hook 412 extending from the post 410. Apertures 414 are formed through the first front panel 408 to attach the post 410 with fasteners, ties, or any suitable retainer.

A side panel 416 is pivotally attached to a lateral side of the first front panel 408. A side flap 418 is pivotally attached to the side panel 416 and a slit in the fold forms a slot 420. Another side panel 422 is pivotally attached to the other lateral side of the first front panel 408. A rear panel 424 is pivotally attached to the side panel 422 with a locking tab 426 to lock in the slot 420 and form a first upper cavity, which may be utilized to store hardware and instructions.

A top panel 428 is pivotally attached to a top of the rear panel 424. A top flap 430 is pivotally attached to the top panel 428 with a slot 432 in the fold. An optional first hang tab 434 is pivotally attached to a top of the first front panel 408. A hang tab aperture 436 is formed through the first hang tab 434. A second hang tab 438 is pivotally attached the first hang tab 434 to increase the support of the first hang tab 434. A hang tab aperture 440 is formed through the second hang tab 438 to align with the first hang tab aperture 436. A locking tab 442 extends from the second locking tab 438 to lock within the slot 432 to the top panel 428.

An intermediate top panel 444 extends forward from the first front panel 408. A second front panel 446 is pivotally connected to the intermediate top panel 444 to extend downward. A side panel 448 is pivotally connected to a lateral side of the second front panel 446. A side flap 450 is pivotally connected to the side panel 448 and provides a slot 452 at the fold. A bottom panel 454 is pivotally connected to a bottom edge of the second front panel 446. A bottom flap 456 is pivotally connected to the bottom panel 454 with a slot 458 at the intersection. A side panel 460 is connected to the other lateral side of the second front panel 446. A second rear panel 462 is pivotally connected to the side panel 460 to rollover a rear side of the package assembly 404 to define a second cavity. A tab 464 extends from a lateral side of the rear panel 462 to lock within the slot 452. A tab 466 extends from a lower edge of the rear panel 462 to lock in the slot 458.

The second cavity may be utilized to extend the second front panel 446 beyond the hooks 412 to avoid contact of the hooks 412 with a sequentially displayed package assembly 404. The second cavity may be utilized to store hardware and instructions. In this option, the first cavity may be omitted according to an embodiment.

Figure 23:
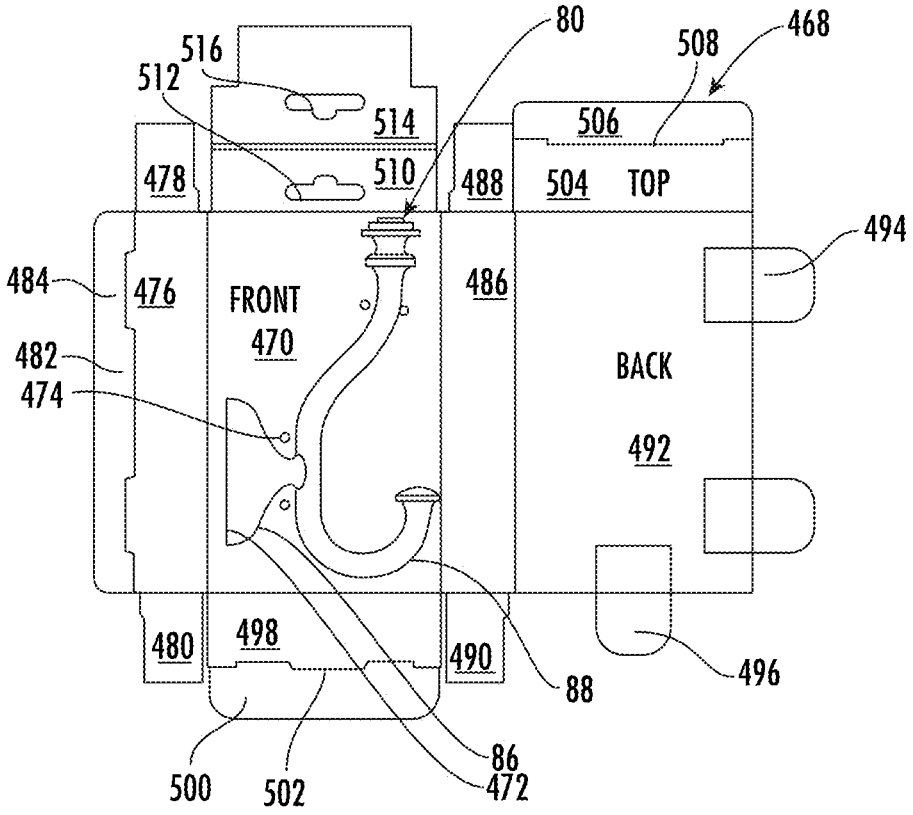
FIG. 23 is a top plan view of a blank of the home hardware package assembly with the hook assembly of FIG. 4 according to another embodiment.

FIG. 23 illustrates a home hardware packaging assembly 468 for the hook assembly 80 according to another embodiment. The package assembly 468 is illustrated as a blank. A front panel 470 includes a post aperture 472 to receive the post 86. A plurality of tie apertures 474 are formed through the front panel 470 to tie the post 86 and the hook 88 to the front panel 470.

A side panel 476 is pivotally connected to a lateral side of the front panel 470. A top flap 478 and a bottom flap 480 are pivotally connected to opposed ends of the side panel 476. A side flap 482 is pivotally connected to the side panel 476. The intersection of the side flap 482 with the side panel 476 is slit and folded to provide slots 484. Another side panel 486 is pivotally connected to another lateral side of the front panel 470. A top flap 488 and a bottom flap 490 are pivotally connected to opposed ends of the side panel 486.

A rear panel 492 is pivotally connected to the side panel 486 to engage the side panel 486 with the side flap 482 within the cavity. A plurality of tabs 494 are provided on the rear panel 492 to lock within the slots 484. Another locking tab 496 extends from a lower end of the back panel 492. The bottom flaps 480, 490 are received within the cavity. A bottom panel 498 is pivotally connected to a bottom of the front panel 470. A central flap 500 is pivotally connected to the bottom panel 498 with a slot 502 at the fold. The tab 496 at the bottom of the back panel 492 locks in the slot 502.

The top flaps 478, 488 also extend into the cavity. A top panel 504 is pivotally connected to a top edge of the back panel 492. A top flap 506 is pivotally connected to the top panel 504 with a slot 508 on the fold. A first hang tab 510 is pivotally connected to the front panel 470 and provides a hang tab aperture 512. A second hang tab 514 is pivotally connected to the first hang tab 510 to extend into the slot 508 and to lock the hang tabs 510, 514 to the top panel 504. A hang tab aperture 516 is provided in the second hang tab 514 aligned with the first hang tab aperture 512.

The home product packaging 468 significantly reduces an amount of material in comparison to the prior art that utilizes an insert within an outer housing or tray with a window. For example, the robe hook product packaging assembly 468 reduces the packaging material by sixty-one percent.

Figure 24:
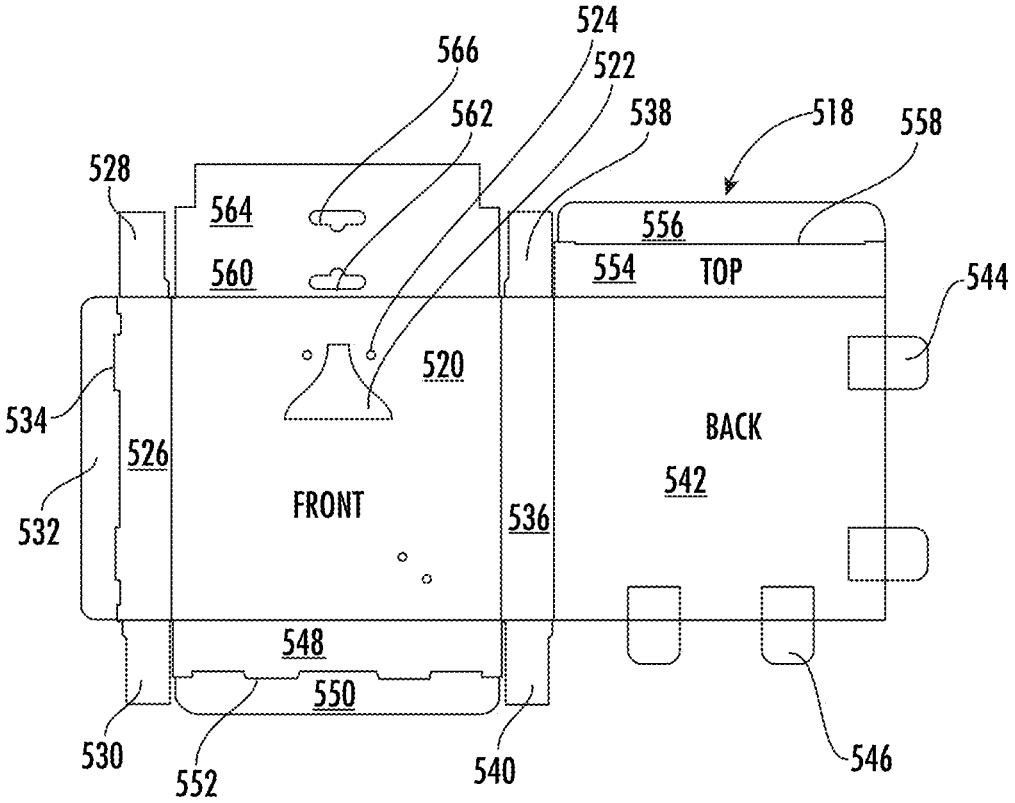
FIG. 24 is a top plan view of a blank of the home hardware package assembly of FIG. 1 according to another embodiment.

FIG. 24 illustrates a home hardware packaging assembly 518 for the towel ring assembly 32 according to another embodiment. The package assembly 518 is illustrated as a blank. A front panel 520 includes a post aperture 522 to receive the post 38. A plurality of tie apertures 524 are formed through the front panel 520 to tie the post 38 and the towel ring 40 to the front panel 520.

A side panel 526 is pivotally connected to a lateral side of the front panel 520. A top flap 528 and a bottom flap 530 are pivotally connected to opposed ends of the side panel 526. A side flap 532 is pivotally connected to the side panel 526. The intersection of the side flap 532 with the side panel 526 is slit and folded to provide slots 534. Another side panel 536 is pivotally connected to another lateral side of the front panel 520. A top flap 538 and a bottom flap 540 are pivotally connected to opposed ends of the side panel 536.

A rear panel 542 is pivotally connected to the side panel 536 to engage the side panel 536 with the side flap 532 within the cavity. A plurality of tabs 544 are provided on the rear panel 542 to lock within the slots 534. Other locking tabs 546 extends from a lower end of the back panel 542. The bottom flaps 530, 540 are received within the cavity. A bottom panel 548 is pivotally connected to a bottom of the front panel 520. A central flap 550 is pivotally connected to the bottom panel 548 with slots 552 at the fold. The tabs 546 at the bottom of the back panel 542 locks in the slot 552.

The top flaps 528, 538 also extend into the cavity. A top panel 554 is pivotally connected to a top edge of the back panel 542. A top flap 556 is pivotally connected to the top panel 554 with a slot 558 on the fold. A first hang tab 560 is pivotally connected to the front panel 520 and provides a hang tab aperture 562. A second hang tab 564 is pivotally connected to the first hang tab 560 to extend into the slot 558 and to lock the hang tabs 560, 564 to the top panel 554. A hang tab aperture 566 is provided in the second hang tab 564 aligned with the first hang tab aperture 562.

The home product packaging 518 significantly reduces an amount of material in comparison to the prior art that utilizes an insert within an outer housing or tray with a window. For example, the towel ring product packaging assembly 518 reduces the packaging material by fifty percent.

Figure 25:
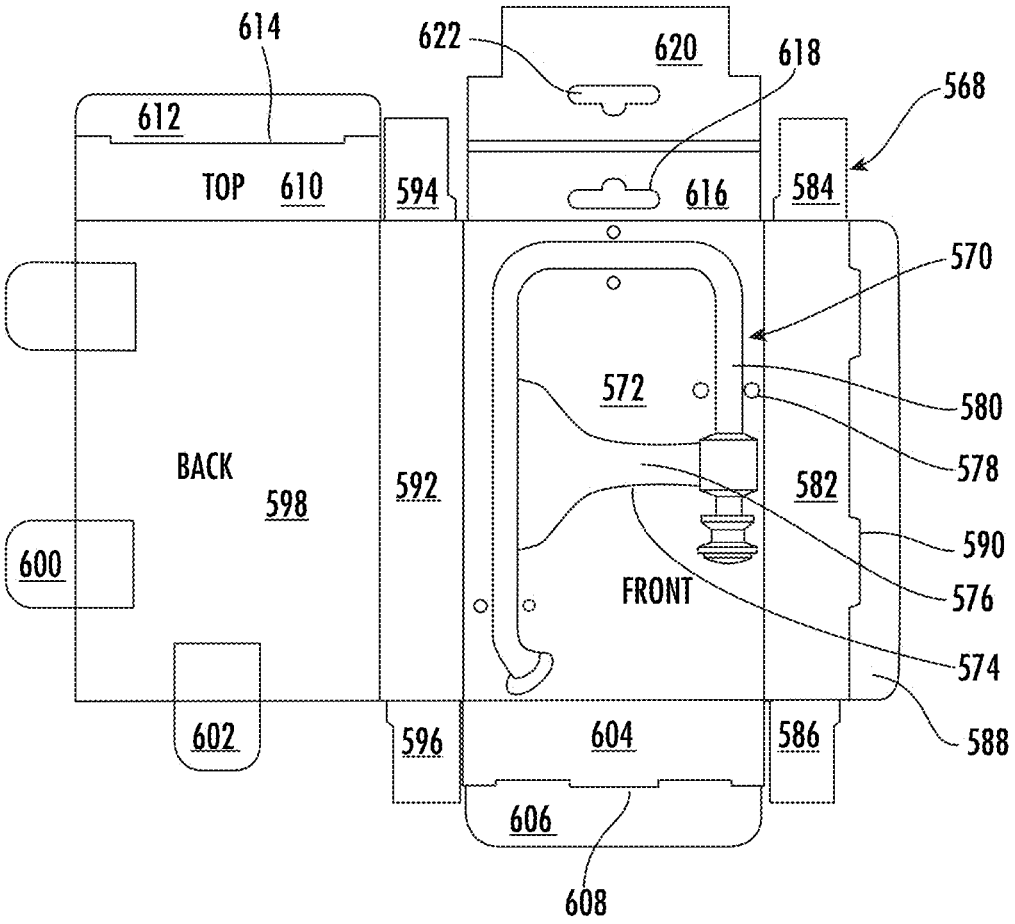
FIG. 25 is a top plan view of a blank of a home hardware package assembly with a toilet paper holder assembly according to another embodiment.

FIG. 25 illustrates a home hardware packaging assembly 568 for a toilet paper holder assembly 570 according to another embodiment. The package assembly 568 is illustrated as a blank. A front panel 572 includes a post aperture 574 to receive a post 576. A plurality of tie apertures 578 are formed through the front panel 572 to tie the post 576 and a toilet paper rod 580 to the front panel 572.

A side panel 582 is pivotally connected to a lateral side of the front panel 572. A top flap 584 and a bottom flap 586 are pivotally connected to opposed ends of the side panel 582. A side flap 588 is pivotally connected to the side panel 582. The intersection of the side flap 588 with the side panel 582 is slit and folded to provide slots 590. Another side panel 592 is pivotally connected to another lateral side of the front panel 572. A top flap 594 and a bottom flap 596 are pivotally connected to opposed ends of the side panel 592.

A rear panel 598 is pivotally connected to the side panel 592 to engage the side panel 582 with the side flap 588 within the cavity. A plurality of tabs 600 are provided on the rear panel 598 to lock within the slots 590. Another locking tab 602 extends from a lower end of the back panel 598. The bottom flaps 586, 596 are received within the cavity. A bottom panel 604 is pivotally connected to a bottom of the front panel 572. A central flap 606 is pivotally connected to the bottom panel 604 with a slot 608 at the fold. The tab 602 at the bottom of the back panel 598 locks in the slot 608.

The top flaps 584, 594 also extend into the cavity. A top panel 610 is pivotally connected to a top edge of the back panel 598. A top flap 612 is pivotally connected to the top panel 610 with a slot 614 on the fold. A first hang tab 616 is pivotally connected to the front panel 572 and provides a hang tab aperture 618. A second hang tab 620 is pivotally connected to the first hang tab 616 to extend into the slot 614 and to lock the hang tabs 616, 620 to the top panel 610. A hang tab aperture 622 is provided in the second hang tab 620 aligned with the first hang tab aperture 618.

The home product packaging 568 significantly reduces an amount of material in comparison to the prior art that utilizes an insert within an outer housing or tray with a window. For example, the toilet paper holder product packaging assembly 568 reduces the packaging material by seventy-six percent.

Figure 26:
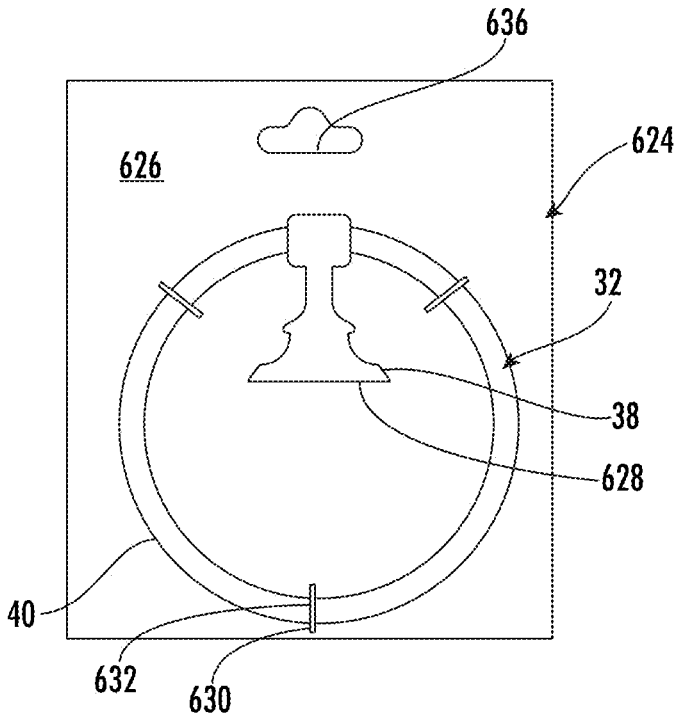
FIG. 26 is a front elevation view of a home hardware package assembly with a towel ring according to an embodiment.
Figure 27:
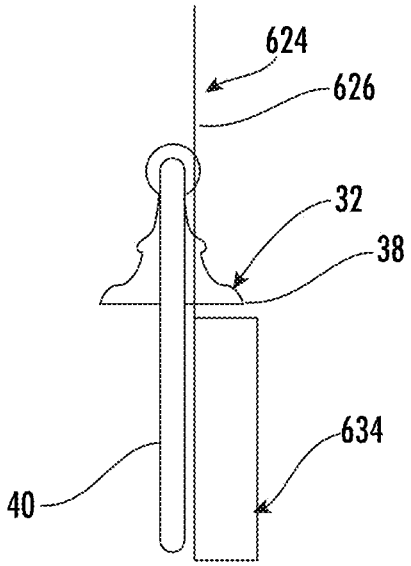
FIG. 27 is a side elevation view of the home hardware package assembly of FIG. 26.

FIGS. 26 and 27 illustrate a home hardware packaging assembly 624 for the towel ring assembly 32 according to another embodiment. The packaging assembly 624 includes a rear panel 626. A post aperture 628 is formed through the rear panel 626 to receive a portion of the post 38. Tie apertures 630 are also formed through the rear panel 626 to receive ties 632 to attach post 38 and the towel ring 40 to the rear panel 626. A plurality of panels form a rear rollover cavity 634 to enclose hardware and instructions. The rear rollover cavity 634 extends further from the rear panel 626 than the post 38 to avoid contact of the post 38 with another sequential post 38 in another packaging assembly 624. A hang tab aperture 636 is formed through the rear panel 626.

The towel ring assembly 32 is almost entirely exposed for consumer access. The packaging assembly 624 may also be utilized for other products, such as toilet paper holder assemblies, and towel bars wherein the cavity 634 only covers one post.

While various embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A package assembly comprising:

a plurality of pivotally connected panels to collectively support a product and define a cavity, wherein an aperture is formed into one of the plurality of pivotally connected panels; and a home hardware product comprising a post with an enlarged terminal end to mount upon a wall mount bracket for installation upon an upright support surface, wherein the home hardware product is affixed to an exterior side of one of the plurality of pivotally connected panels; and wherein the aperture is sized to receive the enlarged terminal end of the post partially in the cavity; and wherein the home hardware product further comprises a hook assembly comprising a hook extending from the post.

2. The package assembly of claim 1 wherein the aperture is formed in a front panel of the plurality of pivotally connected panels; and wherein the front panel serves as a backer card.

3. The package assembly of claim 2 wherein at least two of the plurality of pivotally connected panels are pivoted to rollover relative to the front panel to form the cavity.

4. The package assembly of claim 1 wherein the cavity extends further than the home hardware product to avoid contact with a sequentially displayed home hardware product.

5. The package assembly of claim 1 wherein the plurality of pivotally connected panels further comprises a back panel and two other panels.

6. The package assembly of claim 1 wherein the plurality of pivotally connected panels further comprises a back panel and at least two of a front panel, a side panel, a top panel, and a bottom panel.

7. The package assembly of claim 6 wherein the bottom panel is sized to support the package assembly upon an underlying support surface.

8. The package assembly of claim 1 further comprising a fastener to connect a pair of the plurality of pivotally connected panels.

9. The package assembly of claim 8 wherein the fastener further comprises a tab, an adhesive, tape, or a staple.

10. The package assembly of claim 1 wherein the home hardware product is not mounted to an insert.

11. The package assembly of claim 1 wherein a shrink wrap is not provided over the home hardware product; and wherein an additional protective coating of the package assembly is not provided over the home hardware product.

12. The package assembly of claim 1 wherein a hang tab with a hang tab aperture is formed in one of the plurality of panels.

13. The package assembly of claim 1 further comprising a wall mount bracket housed within the cavity; and wherein the enlarged terminal end of the post is sized to mount upon and conceal the wall mount bracket.

14. The package assembly of claim 1 wherein at least a portion of the post is exposed through the aperture.

15. The package assembly of claim 1 wherein the aperture is sized to match a profile of the enlarged terminal end of the post.

16. The package assembly of claim 1 further comprising ties that extend through the aperture to attach the home hardware product to one of the plurality of panels.

17. The package assembly of claim 1 wherein the package assembly permits customer access to the entire home hardware product.

18. The package assembly of claim 12 wherein the aperture is formed in the front panel; and wherein the hang tab is formed in the front panel and extends above the pivotally connected panels.

19. The package assembly of claim 1 wherein the hook assembly further comprises a double hook extending from the post.

20. A package assembly comprising:

a plurality of pivotally connected panels to collectively support a product and define a cavity, wherein an aperture is formed into one of the plurality of pivotally connected panels; and a home hardware product comprising a post with an enlarged terminal end to mount upon a wall mount bracket for installation upon an upright support surface, wherein the home hardware product is affixed to an exterior side of one of the plurality of pivotally connected panels;

wherein the aperture is sized to receive the enlarged terminal end of the post partially in the cavity; and a wall mount bracket housed within the cavity; and wherein the enlarged terminal end of the post is sized to mount upon and conceal the wall mount bracket.

* * * * *